US005551884A

United States Patent [19]

Burkhart, Sr.

[11] Patent Number: 5,551,884

[45] Date of Patent: Sep. 3, 1996

[54] LOCKING ELECTRICAL OUTLET

[76] Inventor: Steven A. Burkhart, Sr., P.O. Box 532, Spring Arbor, Mich. 49283

[21] Appl. No.: 378,014

[22] Filed: Jan. 25, 1995

[51] Int. Cl.[6] ..... H01R 13/703; H01R 13/44

[52] U.S. Cl. ..... 439/140; 439/188; 439/346; 439/261

[58] Field of Search ..... 439/140, 188, 439/346, 259, 261, 263, 924

[56] References Cited

U.S. PATENT DOCUMENTS

| | | |
|---|---|---|
| 3,350,675 | 10/1967 | Misencik et al. . |
| 3,543,218 | 11/1970 | Archer . |
| 3,805,211 | 4/1974 | Moore . |
| 4,061,409 | 12/1977 | Bealmear . |
| 4,085,991 | 4/1978 | Marshall et al. . |
| 4,136,919 | 6/1979 | Howard et al. . |
| 4,167,658 | 9/1979 | Sherman . |
| 4,530,556 | 7/1985 | Bonus . |
| 4,846,707 | 7/1989 | Pirkle . |
| 4,909,749 | 3/1990 | Long . |
| 4,969,833 | 11/1990 | Lindow et al. . |
| 5,129,836 | 7/1992 | Ursich . |
| 5,286,213 | 2/1994 | Altergott et al. . |

*Primary Examiner*—P. Austin Bradley
*Assistant Examiner*—T. C. Patel
*Attorney, Agent, or Firm*—Richard C. Litman

[57] ABSTRACT

A lockable electrical socket has a pair of grasping jaws which can retain an electrical plug in place. The plug can be released by pushing in the plug and then allowing the plug retaining assembly and the plug to be thrust out under spring pressure. In a second embodiment a key is required to thrust out the plug in order to prevent unauthorized removal of the plug from the socket. A dummy or safety plug can be used in place of an electrical plug to make the lockable socket child-proof.

20 Claims, 8 Drawing Sheets

LOCKING ELECTRICAL OUTLET

BACKGROUND OF THE INVENTION

1. Field of the Invention

The present invention relates to electrical sockets having releasable locking mechanisms to lock the contact prongs of electrical plugs therein.

2. Description of the Prior Art

Typical household electrical sockets normally include an insulated housing having two or three openings for receiving the prongs of an electrical plug. Such electrical sockets suffer many draw backs. For example, as the socket wears, the plug is no longer tightly retained in the socket. The plug may then partially slip out of the socket either due to gravity or minor tugs on the socket. If the plug is grasped in this condition, a risk of electrical shock exists because of the partially exposed prongs. Also the exposed prongs may present a fire hazard.

In addition, conventional sockets present an annoying inconvenience to users who repeatedly have to reinsert inadvertently disconnected plugs.

Further, children are extremely fascinated with electrical outlets, and have a tendency to remove electrical plugs from their outlets and insert objects such as paper clips or other metallic items into the outlet, thus subjecting themselves to the risk of electrocution.

For the aforementioned reasons, many electrical sockets that releasably lock the electrical plug in place, have been proposed in the prior art. The following United States patents all show releasably locking electrical sockets.

| U.S. Pat. No. | Name |
|---|---|
| 5,286,213 | Altergott et al. |
| 5,129,836 | Ursich |
| 4,969,833 | Lindow et al. |
| 4,909,749 | Long |
| 4,846,707 | Pirkle |
| 4,530,556 | Bonus |
| 4,167,658 | Sherman |
| 4,136,919 | Howard et al. |
| 4,085,991 | Marshall et al. |
| 4,061,409 | Bealmear |
| 3,805,211 | Moore |
| 3,543,218 | Archer |
| 3,350,675 | Misencik et al. |

However, none of the cited references teach or suggest a pair of hinged jaws for grasping the prongs of a plug, with the jaws being mounted to a carrier capable of reciprocating movement within the socket.

None of the above inventions and patents, taken either singly or in combination, is seen to describe the instant invention as claimed.

SUMMARY OF THE INVENTION

The present invention is directed to a lockable electrical socket that has a pair of grasping jaws which can retain a plug in place. The plug can be released by pushing in the plug and then allowing the plug retaining assembly and the plug to be thrust out under spring pressure.

Accordingly, it is a principal object of the invention to provide an electrical socket that releasably locks electrical plugs in place. It is another object of the invention to provide a lockable electrical socket which can be locked and unlocked by simply pushing in the plug.

It is a further object of the invention to provide a lockable electrical socket which can be unlocked by a key to prevent unauthorized access thereto.

Still another object of the invention is to provide a socket that can releasably retain a safety plug to prevent children from inserting metal objects therein.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
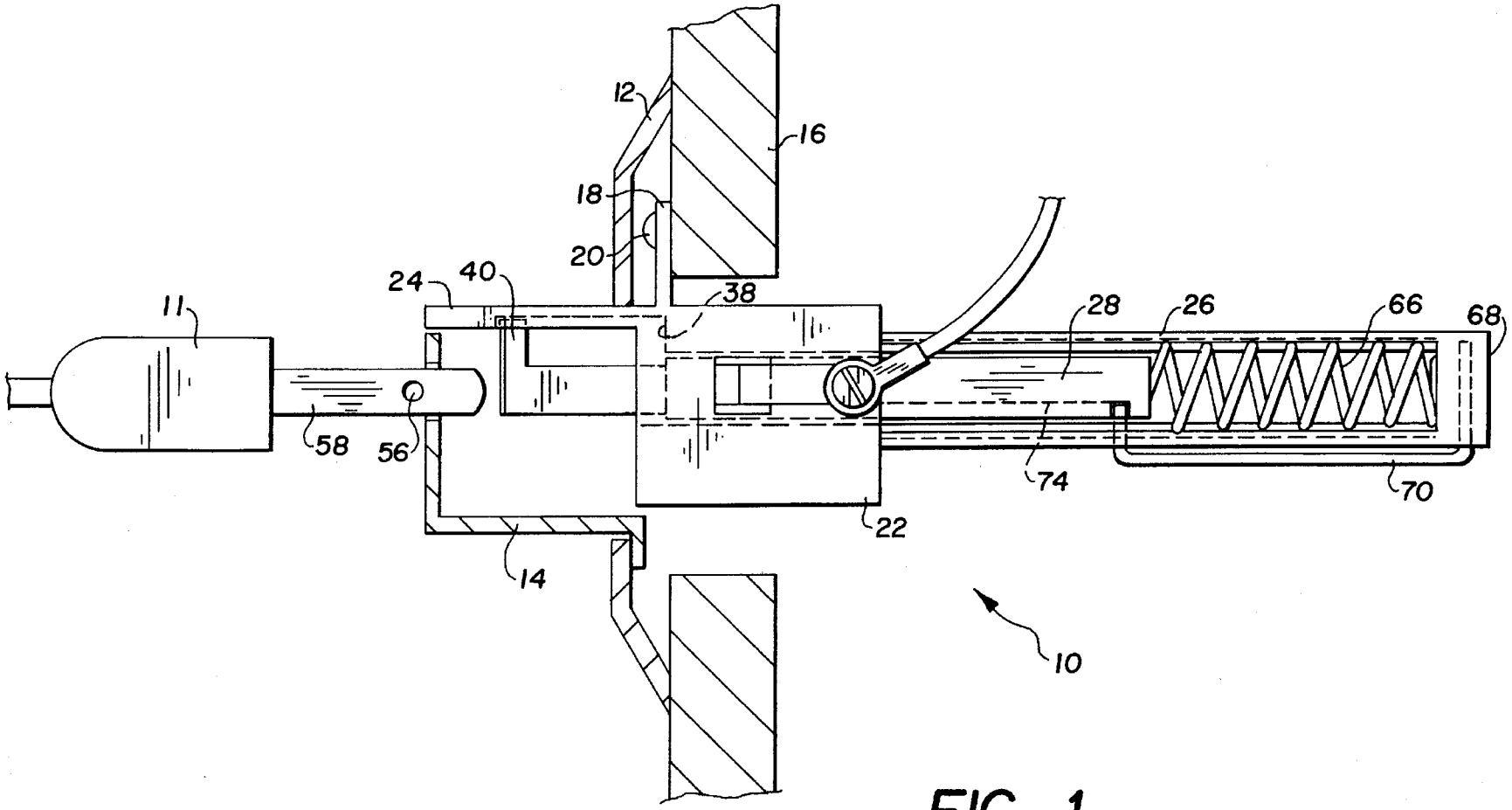
FIG. 1 is a side elevational view of the locking socket of the present invention.
Figure 2:
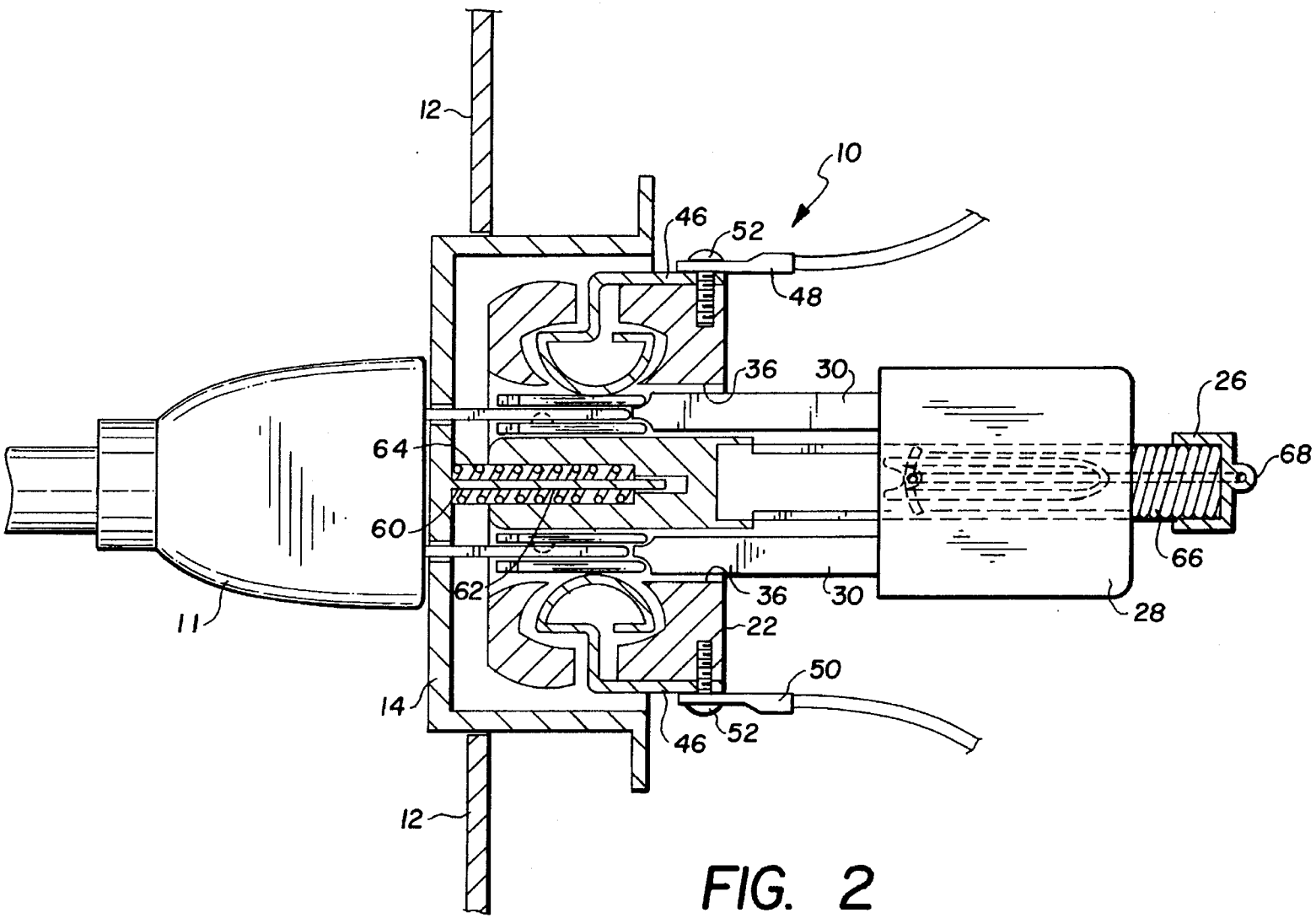
FIG. 2 is a top cross sectional view of the locking socket of the present invention showing the locking assembly in the locked position.

Referring to FIGS. 1–6, the present invention is directed to an electrical outlet or socket 10 which releasably locks a plug 11 in place. The socket 10 includes a decorative face plate 12, a sliding cap 14, a housing assembly, and a locking assembly.

The socket 10 is generally secured within an opening in the wall 16 using the flange 18 and the screw 20. The face plate 12 fits around the sliding cap 14 and serves to conceal the opening in the wall 16. The housing assembly includes a housing 22, an overhang 24, and a spring guide 26. The locking assembly includes a carrier 28 and arms 30. At the end of each arm 30 is a pair of locking jaws 32 and 34.

The housing 22 has a pair of passages 36 for allowing the arms 30 to pass therethrough. Each passage 36 extends from the face of the housing 22 adjacent the spring guide 26, to the face of the housing distal to the spring guide 26. The ends of the passages 36, distal from the spring guide 26, have cavities 38 extending therefrom to accommodate guide extensions 40. The guide extensions 40 ride in respective guide grooves 42, which are provided on the underside of the overhang 24 and extend from the cavities 38. The guide grooves 42 act to keep the jaws 32 and 34 apart when the locking assembly is in the unlocked position, thus keeping the jaws 32 and 34 ready for receiving the plug 11.

Each of the passages 36 has a lateral cavity 44 adjacent thereto. The cavities 44 are in open communication with passages 36 and house spring steel contacts 46. The spring steel contacts 46 contact the jaws 32 and 34 when the locking assembly is in the locked position. The spring steel contacts are resiliently biased to press against the arms 30 and the jaws 32 and 34 at all times. Each of the spring steel contacts 46 is connected to the household current supply via respective lead wires 48 and 50. Lead wires 48 and 50 are maintained in contact with contacts 46 by screws 52.

The jaws 32 and 34 are made of a conductive material so that the plug 11 will be conductively connected to lead wires 48 and 50 when the plug 11 is inserted in the socket and the locking assembly is in the locked position. The arms 30 may or may not be made of conductive materials. The carrier 28 must be made of none conductive materials such as plastic if the arms 30 are conductive. However, the only constraint on the choice of materials for the various components of the socket 10, is that the materials should be chosen such that short circuits between the pairs of locking jaws 32 and 34 are prevented. Each of the jaws 32 has a bulge 54 which matingly engages the holes 56 in the prongs 58 of the plug 11.

The cap 14 is spring biased to project outward from the face plate 12, so as to remain in contact with the plug 11 at all times. This feature prevents the prongs 58 from being exposed to the touch. In the example shown in the illustrations, a guide rod 60 telescopes within a guide cavity 62. A spring 64 surrounds the guide rod 60, and extends between a shoulder within guide cavity 62 and the cap 14. The spring 64 biases the cap 14 toward constant contact with plug 11. Alternatively, the jaws 32 and 34 can be dimensioned to abut against cap 14 at all times. Under these circumstances, the locking assembly acts to bias the cap 14 toward constant contact with plug 11 thereby obviating the need for spring 64.

The spring guide 26 is generally a hollow cylindrical tube attached to the rear face of the housing 22 at a first end, the rear face being the face distal from the guide cavity 62. The second end of the spring guide 26 is closed and acts to retain the main spring 66 within the spring guide 26. A boss 68 is provided at the second end of the spring guide 26. The guide pin 70 has one end fixedly embedded in the boss 68. Alternatively, the guide pin 70 may be free to rotate within the boss 68. The other end of the guide pin 70 passes through the curved slot 72 in the underside of spring guide 26, and rides in the cam track 74 in the underside of the carrier 28.

The medial portion 76 of the carrier 28 rides in the spring guide 26. Lateral portions 78 of the carrier 28 protrude from lateral slots on either side of the spring guide 26, and have the arms 30 rigidly fixed thereto. Therefore, the carrier 28, the arms 30, and the jaws 32 and 34, move as a unit. The lateral slots on either side of the spring guide 26 extend along the length of the spring guide 26 for substantially the entire length of the spring guide 26, in order to allow the carrier 28 to reciprocate within the spring guide 26.

Figure 3:
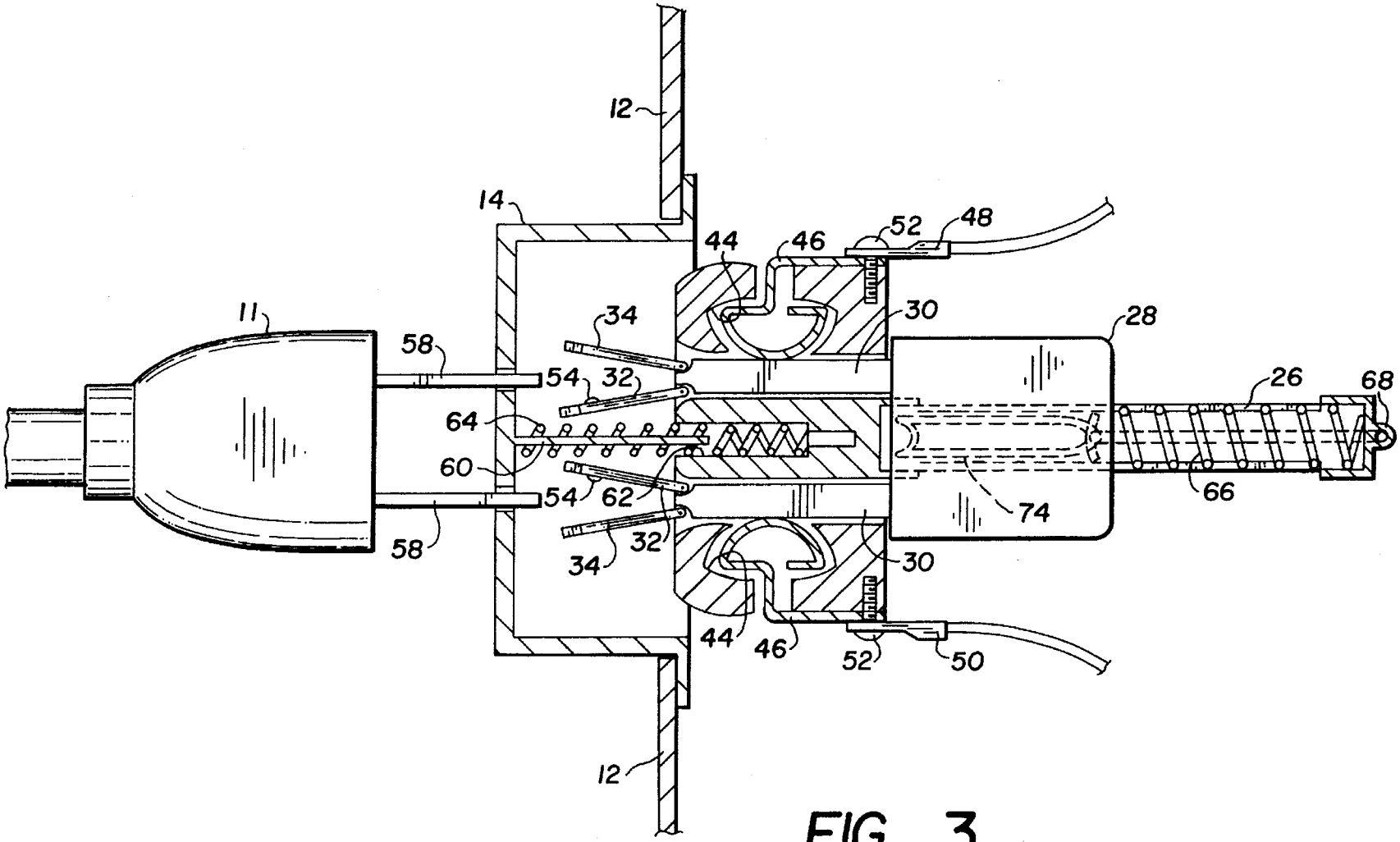
FIG. 3 is a top cross sectional view of the locking socket of the present invention showing the locking assembly in the unlocked position.
Figure 4:
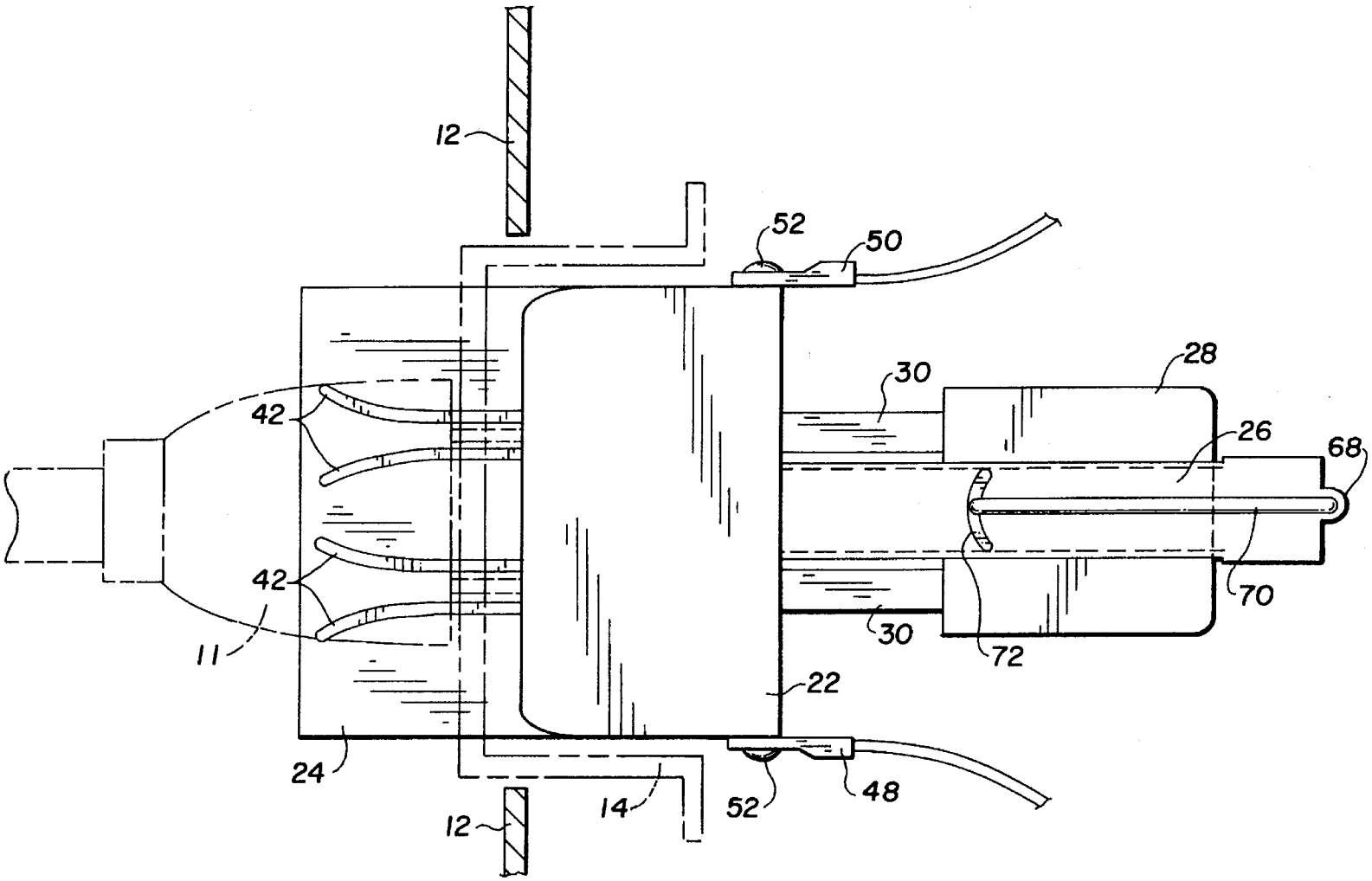
FIG. 4 is a bottom view of the locking socket of the present invention with the locking assembly in the locked position.
Figure 7:
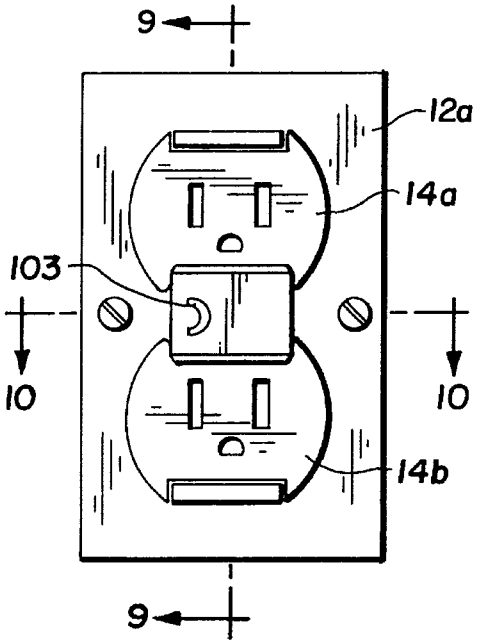
FIG. 7 is a front view of the twin locking sockets of the present invention.
Figure 6:
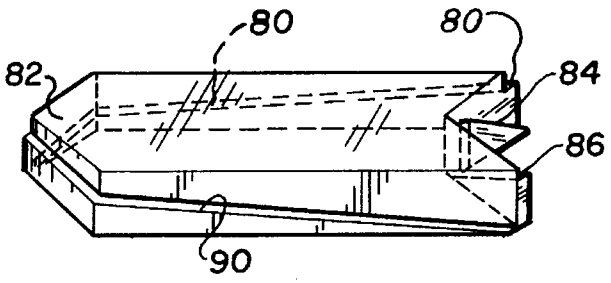
FIG. 6 is a fragmentary view showing the profile of the cam track on the bottom of the locking assembly.
Figure 5:
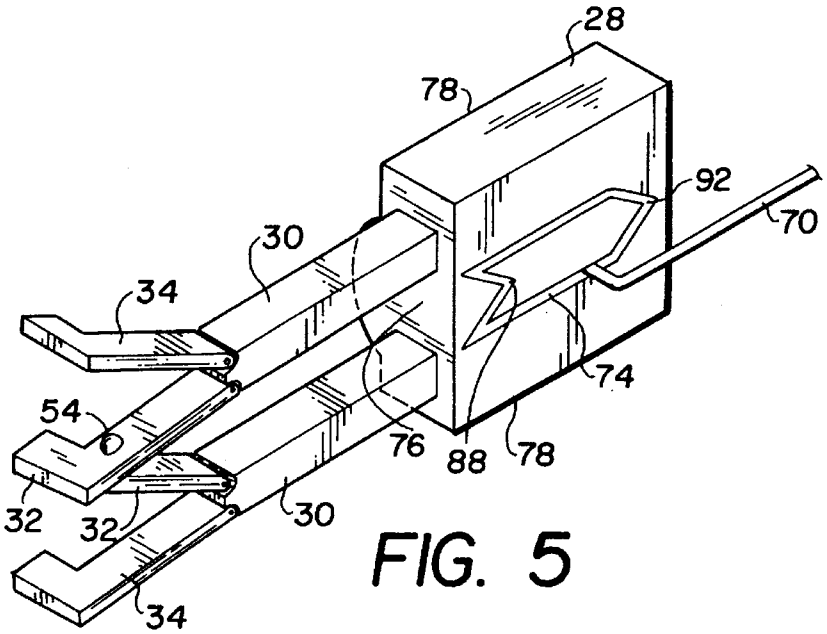
FIG. 5 is a perspective view of the locking assembly of the present invention showing the cam track on the bottom thereof.
Figure 8:
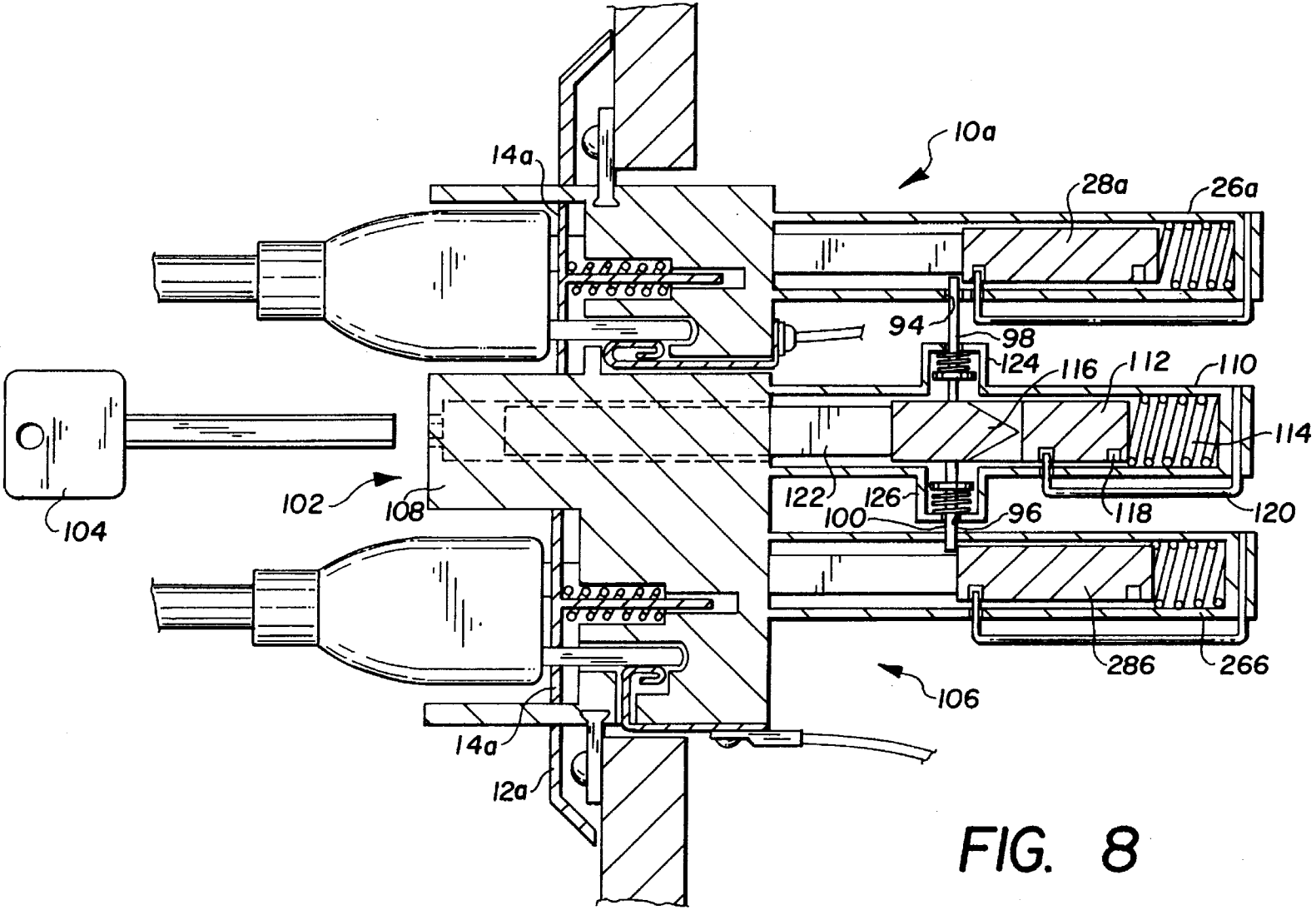
FIG. 8 is a cross sectional side view of the twin locking sockets of the present invention showing both locking assemblies and the key operated lock in the locked position.
Figure 9:
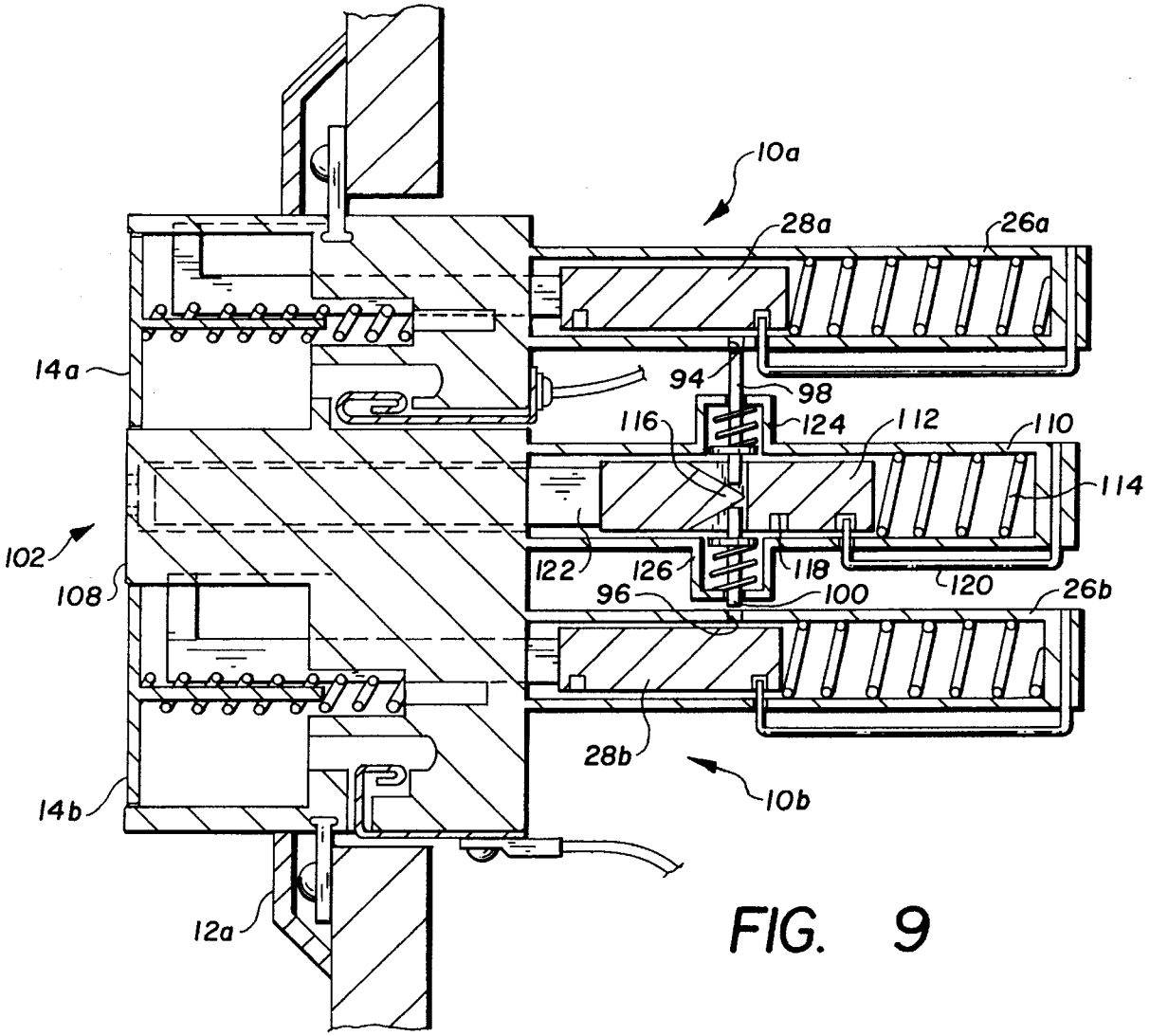
FIG. 9 is a cross sectional side view of the twin locking sockets of the present invention showing both locking assemblies and the key operated lock in the unlocked position.
Figure 10:
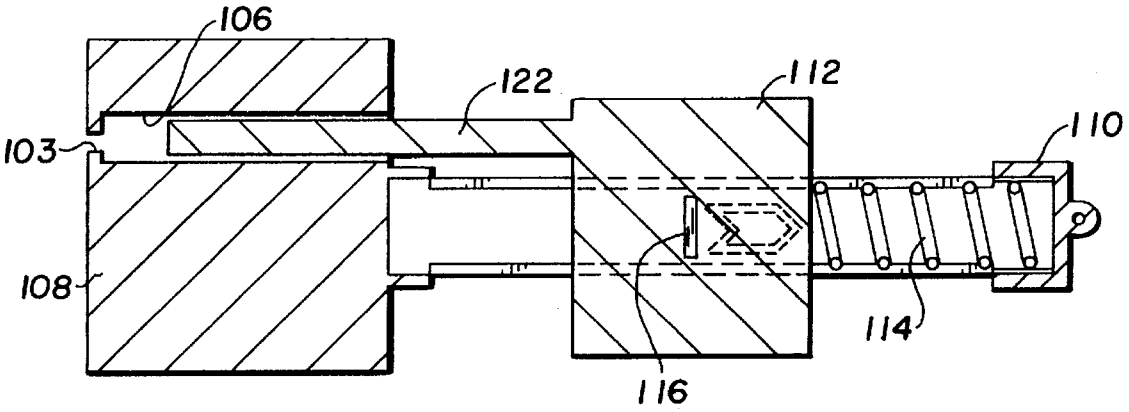
FIG. 10 is top cross sectional view of the twin locking sockets of the present invention showing the key operated lock.

To illustrate the operation of the socket 10, the socket 10 is initially considered in the unlocked state as shown in FIGS. 1 and 3. In the unlocked state the carrier 28 is fully forward along the spring guide 26, the cap 14 extends fully outward from face plate 12, and jaws 32 and 34 extend fully outward from the housing 22. The guide extensions 40 keep the jaws 32 and 34 apart by virtue of their position along guide grooves 42. Main spring 66 urges the carrier 28 forward, and the guide pin 70 engages the cam track 74 at its rear most point.

When a plug 11 is being inserted in the socket 10, the prongs 58 pass through the corresponding openings in the cap 14 until the face of plug 11 abuts against cap 14. As the plug is pushed in further, the prongs 58 engage respective arms 30 between the hinges which hold jaws 32 and 34 to the arms 30. As the plug is pushed in still further, the entire locking assembly, which includes jaws 32 and 34, arms 30, and carrier 28, begins to move toward the rear of the spring guide 26. At this time, the rearward movement of the carrier 28 within the spring guide 26 begins to compress main spring 66.

Also, as the carrier 28 moves to the rear, the end of the guide pin 70 engaging the cam track 74 is forced to the side and outward within cam track 74 by the ramp 80 (see FIG. 6) and the camming surface 82. The guide pin 70 is sufficiently resilient to allow its end, engaging cam track 74, to follow the camming profile of the cam track 74. In addition, rearward movement of the locking assembly causes the jaws 32 and 34 to come together under the influence of guide extensions 40 riding in guide grooves 42. As the locking assembly nears the limit of its rearward travel, the guide grooves 42 cause the jaws 32 and 34 to tightly grasp the prongs 58 with the bulges 54 engaging holes 56.

When the locking assembly reaches the limit of its rearward travel, the end of the pin 70 engaging cam track 74 snaps over the end of ramp 80 and engages the deepest point of ramp 84. When pressure on plug 11 is released, the carrier 28 moves forward under the thrust provided by main spring 66. This forward movement is limited and is not sufficient to disengage jaws 32 and 34 from the prongs 58. During this limited forward motion, the guide pin 70 is urged upward within cam track 74 by ramp 84. At the end of this limited forward motion, the guide pin 70 snaps over the shallow end of the ramp 84 onto the deepest part of the ramp 86. Because the main spring 66 constantly urges the carrier 28 forward, the end of the guide pin 70 engaging cam track 74 becomes trapped in the point of the forward V-shaped portion 88 of the cam track 74. In this position the guide pin 70 acts as a stop preventing further forward movement of the carrier 28 and maintaining the socket 10 in the locked state.

To unlock the socket 10 and remove the plug 11, the plug is first pushed in to move the guide pin 70 out of the point of the forward V-shaped portion 88 of the cam track 74, under the influence of the ramp 86. When the carrier 28 reaches the limit of its rearward motion, the guide pin 70 snaps over the shallow end of the ramp 86 and onto the deep end of the ramp 90. When pressure on the plug 11 is released, the carrier 28 moves forward under the influence of main spring 66. During this forward motion, the guide pin 70 is in continuous contact with ramp 90 and allows the carrier 28 to move to its fully forward position. Also during this forward motion, the guide grooves 42 acting on guide extensions 40, urge the jaws 32 and 34 apart thus releasing plug 11. At the end of this forward motion the guide pin 70 snaps over the shallow end of the ramp 90 and comes to rest at the point of the rearmost V-shaped portion 92 of the cam track 74. With guide pin 70 in this position the socket 10 is in the unlocked state and the plug 11 can be removed.

FIGS. 7 to 10 show the second embodiment of the present invention. The second embodiment of the present invention includes two vertically spaced locking sockets 10*a* and 10*b*, which are substantially identical in structure and function to the locking socket 10 described previously. The locking sockets 10*a* and 10*b* differ from the locking socket 10 in that openings 94 and 96 are provided in spring guides 26*a* and 26*b* respectively. The holes 94 and 96 are positioned slightly forward of the frontmost face of respective carriers 28*a* and 28*b*, when the carriers are in the rearmost position.

A key lock 102 is provided between the locking sockets 10*a* and 10*b*. The key lock 102 includes a C-shaped key hole 103 which allows only the key 104, which has a matchingly shaped cross section, to be inserted into the key way 106. The key way 106 extends from immediately behind the key hole 103 to the rear of the housing 108.

A spring guide 110, similar in structure to spring guide 26, is provided at the rear of the housing 108. The spring guide 110 houses a wedge carrier 112 and main spring 114. The wedge carrier 112 carries a wedge 116 and has a cam track 118 which functions in the same manner as cam track 74 discussed previously. Cam track 118 is engaged by a guide pin 120 which functions in exactly the same manner as described previously in reference to guide pin 70.

The arm 122 is fixed to the wedge carrier 112 and extends into the key way 106 for the entire range of movement of the wedge carrier 112. The arm 122 extends sufficiently into the key way 106 at all times to allow the key 104 to impart movement to the wedge carrier 112.

The spring guide 110 further includes pin housings 124 and 126 provided on the top and bottom of the spring guide 110. each of the pin housings 124 and 126 are open to the interior of the spring guide 110 at one end. The pin housings 124 and 126 house respective jamming pins 98 and 100. The jamming pins 98 and 100 protrude from pin housings 124 and 126 and register with holes 94 and 96 respectively. The jamming pins 98 and 100 are spring biased to move toward the wedge carrier 112.

In the same manner as described with regard to carrier 28, the wedge carrier 112 can be moved into the locking position by pushing the wedge carrier 112 in with the key 104. Once the wedge carrier 112 reaches its rearmost position, releasing the key 104 allows the wedge carrier 112 to move slightly forward under the influence of main spring 114, to trap the pin 120 in the forward V-shaped portion of the cam track 118. To release the key lock 102, the wedge carrier 112 is first pushed in with key 104 and then allowed to move forward to its forwardmost position under the force of main spring 114. The release of wedge carrier 112 is effected through the interaction of the guide pin 120 and the cam track 118 in the same manner as described in reference to carrier 28 and guide pin 70.

As the wedge carrier 112 moves into the locked position, the wedge 116 forces jamming pins 98 and 100 into the interior of respective spring guides 26*a* and 26*b*. With the wedge carrier 112 in the locked position, jamming pins 98 and 100 protrude into respective spring guides 26*a* and 26*b* and act to retain the carriers 28*a* and 28*b* in the locked position. When the wedge carrier 112 is released, the jamming pins 98 and 100 move out of the path of carriers 28*a* and 28*b* under the influence of the respective biasing springs. Sockets 10*a* and 10*b* can then be unlocked in the normal manner described with respect to socket 10.

It should be noted that socket 10*a* and 10*b* are suited for plugs of the three prong type to illustrate the applicability of the locking socket of the present invention to three prong plugs. Hence, the need for the additional ground contacts 128 and 130, which are shown in sockets 10*a* and 10*b*.

Also, the illustrated embodiments are provided as examples only. The guide grooves 42 can be replaced by spring which bias jaws 32 and 34 in the open position. Then as the jaws are pushed into passages 36, they are clamp about the prongs 58. In addition, the jaws need not be as long as they are shown in the examples. They need only be long enough to extend from the tips of prongs 58 to the holes 56. Both these modifications allow a design having sliding socket caps and a key lock which are substantially flush with the face plate 12, when in the locked state.

Figure 11:
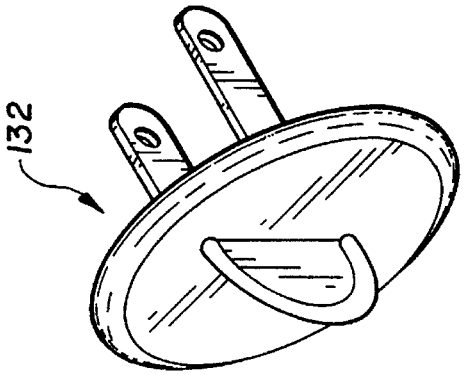
FIG. 11 is perspective view of the safety or dummy plug used with the locking socket of the present invention.

FIG. 11 shows a non-conductive safety or dummy plug 132, which can replace the standard plugs. With the dummy plug in place in a locked socket, children are prevented from inserting objects into the sockets. Thus rendering the locking sockets of the present invention far safer than ordinary sockets.

It is to be understood that the present invention is not limited to the embodiments described above, but encompasses any and all embodiments within the scope of the following claims.

I claim:

1. A locking socket comprising:

a housing having a front face, a rear face, a first passage extending from said front face to said rear face, and a second passage spaced apart from and parallel to said first passage, said second passage extending from said front face to said rear face, said first passage intersecting said front face to form a first front opening, said first passage intersecting said rear face to form a first rear opening, said second passage intersecting said front face to form a second front opening, and said second passage intersecting said rear face to form a second rear opening;

a guide fixed to said rear face and positioned between said first rear opening and said second rear opening, said guide extending from said rear face for a predetermined distance;

a carrier member slidably mounted to said guide and movable between a locked position and an unlocked position, said carrier member having first and second lateral portions in registry with respective ones of said first and second passages when said carrier member is mounted to said guide;

first and second arms each extending from a respective one of said first and second lateral portions and into a respective one of said first and second passages, said first arm terminating at a first support end distal from said carrier member, and said second arm terminating at a second support end distal from said carrier member;

a first pair of grasping jaws hingedly supported at said first support end, said first pair of grasping jaws protruding from said first front opening for a first distance, and being in an open configuration, when said carrier member is in the unlocked position, and said first pair of grasping jaws having a greater portion thereof being retracted into said first passage when said carrier member is in the locked position, than is in the case when said carrier member is in the unlocked position, and said first pair of grasping jaws being in a closed configuration when said carrier member is in the locked position; and a second pair of grasping jaws hingedly supported at said second support end, said second pair of grasping jaws protruding from said second front opening for said first distance, and being in an open configuration, when said carrier member is in the unlocked position, and said second pair of grasping jaws having a greater portion thereof being retracted into said second passage when said carrier member is in the locked position, than is the case when said carrier member is in the unlocked position, and said second pair grasping jaws being in a closed configuration when said carrier member is in the locked position, whereby a plug having at least first and second prongs can be firmly held within said locking socket, with each of said first and second prongs being grasped by a respectively one of said first and second pairs of grasping jaws, when said carrier member is in the locked position.

2. The locking socket according to claim 1, further comprising:

a first lateral cavity provided adjacent said first passage and in open communication therewith, said first lateral cavity housing a first conductive contact biased to protrude into said first passage; and a second lateral cavity produced adjacent said second passage and in open communication therewith, said second lateral cavity housing a second conductive contact biased to protrude into said second passage, whereby said first and second pair of grasping jaws are in contact with a respective one of said first and second conductive contacts when said carrier member is in the locked position.

3. The locking socket according to claim 1, further comprising:

a cap slidably mounted on said housing and concealing said front face, said cap having at least two openings, said at least two openings registering with said first front opening and said second front opening respectively, said cap being biased to contact an electrical plug, having at least two prongs, inserted into said locking socket, whereby the prongs of the electrical plug are concealed.

4. The locking socket according to claim 1, further including a safety plug having at least two prongs, said safety plug being insertable in said locking socket to render said locking socket child proof.

5. The locking socket according to claim 1, wherein said guide includes a top member and a bottom member extending in parallel from said rear face and terminating respectively in a top member end and a bottom member end, said carrier member being slidably supported between said top member and said bottom member, and a closed end extending between said top member end and said bottom member end.

6. The locking socket according to claim 5, wherein said carrier member has an underside and a cam track is provided in said underside, said bottom member has a slot provided therein, and said locking socket further includes a guide pin protruding through said slot provided in said bottom member and engaging said cam track.

7. The locking socket according to claim 6, further including a main spring interposed between said carrier member and said closed end, said main spring exerting a force on said carrier member, and said force being in a direction toward said housing.

8. The locking socket according to claim 7, wherein said cam track is formed by a groove defining a closed circuit, said groove having a first track portion having first and second ends, a second track portion having first and second ends, a third track portion having first and second ends, a fourth track portion having first and second ends, a fifth track portion having first and second ends, and a sixth track portion having first and second ends, the second end of said first track portion being contiguous with the first end of said second track portion, the second end of said second track portion being contiguous with the first end of said third track portion, the second end of said third track portion being contiguous with the first end of said fourth track portion, the second end of said fourth track portion being contiguous with the first end of said fifth track portion, the second end of said fifth track portion being contiguous with the first end of said sixth track portion, and the second end of said sixth track portion being contiguous with the first end of said first track portion, said groove having a forward V-shaped portion and a rear V-shaped portion parallel to said forward V-shaped portion, said forward V-shaped portion being positioned closer, relative to said rear V-shaped portion, to said housing along the underside of said carrier member, said forward V-shaped portion having a mouth and a point, said forward V-shaped portion being defined by said first track portion and said second track portion, the mouth of said forward V-shaped portion being defined by a dimension extending between the first end of said first track portion and the second end of said second track portion, and the point of said forward V-shaped portion being defined by the contiguity of the second end of said first track portion and the first end of said second track portion, the mouth of said forward V-shaped portion being closer to said housing relative to the point of said forward V-shaped portion, said rear V-shaped portion having a mouth and a point, said rear V-shaped portion being defined by said fifth track portion and said fourth track portion, the mouth of said rear V-shaped portion being defined by a dimension extending between the second end of said fifth track portion and the first end of said fourth track portion, and the point of said rear V-shaped portion being defined by the contiguity of the first end of said fifth track portion and the second end of said fourth track portion, the mouth of said rear V-shaped portion being closer to said housing relative to the point of said rear V-shaped portion, further the depth of said groove decreasing from a maximum value, attained at about the first end of said second track portion, to a minimum value attained at about the second end of said second track portion, the depth of said groove decreasing from said maximum value, attained at about the first end of said third track portion, to said minimum value attained at about the second end of said fourth track portion, the depth of said groove decreasing from said maximum value, attained at about the first end of said fifth track portion, to said minimum value attained at about the second end of said sixth track portion, and the depth of said groove decreasing from said maximum value, attained at about the first end of said first track portion, to said minimum value attained at about the second end of said first track portion, whereby said guide pin is positioned at about the first end of said second track portion when said carrier member is in the locked position, and a plug being held by said locking socket can be released by pushing the plug toward said housing thereby positioning said guide pin at about the first end of said third track portion, and then allowing the plug to move away from said housing due to the force exerted by said main spring, while simultaneously allowing said carrier member to move toward said housing, urged by the force exerted by said main spring, until said guide pin is positioned at about the first end of said fifth track portion thereby retaining said carrier member in said unlocked position.

9. The locking socket according to claim 1, further including means for retaining said first and second pairs of grasping jaws in the open configuration when said carrier member is in the unlocked position.

10. The locking socket according to claim 9, wherein said means for retaining said first and second pairs of grasping jaws in the open configuration include:

an overhang provided on said front face of said housing, said overhang having first and second pairs of guide grooves therein, each of said first and second pairs of guide grooves being positioned generally above a respective pair of said first and second pairs of grasping jaws, each one of said first pair of guide grooves and each one of said second pair of guide grooves having an end proximate said front face and an end distal from said front face, a distance between said first pair of guide grooves and a distance between said second pair of guide grooves varying from a minimum distance, proximate said front face, to a maximum distance, distal from said front face;

a first pair of guide extensions, each one of said first pair of guide extensions being provided on a respective one of said first pair of grasping jaws at an end thereof distal from said first support end, said first pair of guide extensions engaging respective ones of said first pair of guide grooves; and a second pair of guide extensions, each one of said second pair of guide extensions being provided on a respective one of said second pair of grasping jaws at an end thereof distal from said second support end, said second pair of guide extensions engaging respective ones of said second pair of guide grooves, whereby the ends of said first pair of grasping jaws distal from said first support end, and the ends of said second pair of grasping jaws distal from said second support end, are maintained apart at said maximum distance when said first and second pairs of grasping jaws protrude from said front face for said first distance.

11. A twin locking socket comprising:

a first locking socket including, a first housing having a first front face, a first rear face, a first passage extending from said first front face to said first rear face, and a second passage spaced apart from and parallel to said first passage, said second passage extending from said first front face to said first rear face, said first passage intersecting said first front face to form a first front opening, said first passage intersecting said first rear face to form a first rear opening, said second passage intersecting said first front face to form a second front opening, and said second passage intersecting said first rear face to form a second rear opening, a first guide fixed to said first rear face and positioned between said first rear opening and said second rear opening, said first guide extending from said first rear face for a predetermined distance, and said first guide having a first jamming pin opening, a first carrier member slidably mounted to said first guide and movable between a first locked position and a first unlocked position, said first carrier member having first and second lateral portions in registry with respective ones of said first and second passages when said first carrier member is mounted to said first guide, first and second arms each extending from a respective one of said first and second lateral portions and into a respective one of said first and second passages, said first arm terminating at a first support end distal from said first carrier member, and said second arm terminating at a second support end distal from said first carrier member, a first pair of grasping jaws hingedly supported at said first support end, said first pair of grasping jaws protruding from said first front opening for a first distance, and being in an open configuration, when said first carrier member is in the first unlocked position, said first pair of grasping jaws having a greater portion thereof being retracted into said first passage when said first carrier member is in the first locked position, than is the case when said first carrier member is in the first unlocked position, and said first pair of grasping jaws being in a closed configuration when said first carrier member is in the first locked position, and a second pair of grasping jaws hingedly supported at said second support end, said second pair of grasping jaws protruding from said second front opening for said first distance, and being in an open configuration, when said first carrier member is in the first unlocked position, said second pair of grasping jaws having a greater portion thereof being retracted into said second passage when said first carrier member is in the first locked position, than is the case when said first carrier member is in the first unlocked position, and said second pair of grasping jaws being in a closed configuration when said first carrier member is in the first locked position, whereby a first plug having at least first and second prongs can be firmly held within said first locking socket, with each of said first and second prongs of said first plug being grasped by a respective one of said first and second pairs of grasping jaws, when said first carrier member is in the first locked position;

a second locking socket including, a second housing having a second front face, a second rear face, a third passage extending from said second front face to said second rear face, and a fourth passage spaced apart from and parallel to said third passage, said fourth passage extending from said second front face to said second rear face, said third passage intersecting said second front face to form a third front opening, said third passage intersecting said second rear face to form a third rear opening, said fourth passage intersecting said second front face to form a fourth front opening, and said fourth passage intersecting said second rear face to form a fourth rear opening, a second guide fixed to said second rear face and positioned between said third rear opening and said fourth rear opening, said second guide extending from said second rear face for said predetermined distance, and said second guide having a second jamming pin opening, a second carrier member slidably mounted to said second guide and movable between a second locked position and a second unlocked position, said second carrier member having third and fourth lateral portions in registry with respective ones of said third and fourth passages when said second carrier member is mounted to said second guide, third and fourth arms each extending from a respective one of said third and fourth lateral portions and into a respective one of said third and fourth passages, said third arm terminating at a third support end distal from said second carrier member, and said fourth arm terminating at a fourth support end distal from said second carrier member, a third pair of grasping jaws hingedly supported at said third support end, said third pair of grasping jaws protruding from said third front opening for said first distance, and being in an open configuration, when said second carrier member is in the second unlocked position, said third pair of grasping jaws having a greater portion thereof being retracted into said third passage when said second carrier member is in the second locked position, than is the case when said second carrier member is in the second unlocked position, and said third pair of grasping jaws being in a closed configuration when said second carrier member is in the second locked position, and a fourth pair of grasping jaws hingedly supported at said fourth support end, said fourth pair of grasping jaws protruding from said fourth front opening for said first distance, and being in an open configuration, when said second carrier member is in the second unlocked position, said fourth pair of grasping jaws having a greater portion thereof being retracted into said fourth passage when said second carrier member is in the second locked position, than is the case when said second carrier member is in the second unlocked position, and said fourth pair of grasping jaws being in a closed configuration when said second carrier member is in the second locked position, whereby a second plug having at least first and second prongs can be firmly held within said second locking socket, with each of said first and second prongs of said second plug being grasped by a respective one of said third and fourth pairs of grasping jaws, when said second carrier member is in the second locked position; and a key lock provided between said first and second locking sockets, said key lock including, a key lock housing having a key way and a key hole in communication with said key way, said key hole having a first cross sectional shape, a key lock guide extending from said key lock housing and positioned between said first guide and said second guide, said key lock guide having a closed end, a wedge carrier slidably mounted on said guide, said wedge carrier being movable between a third locked positioned and a third unlocked position, and said wedge carrier having a wedge, said wedge having an upper surface and a lower surface, a key lock arm extending from said wedge carrier and having at least a portion thereof positioned within said key way, a key insertably through said key hole and having said first cross sectional shape, said key being usable for imparting movement to said wedge carrier via said key lock arm, a key lock spring positioned between said wedge carrier and said closed end of said key lock guide, said key lock spring biasing said wedge carrier toward said key lock housing, a first jamming pin provided between said key lock guide and said first guide, said first jamming pin being biased to contact said upper surface of said wedge and being in registry with said first jamming pin opening, a second jamming pin provided between said key lock guide and said second guide, said second jamming pin being biased to contact said lower surface of said wedge and being in registry with said second jamming pin opening, whereby said first jamming pin protrudes into said first guide and prevents movement of said first carrier member out of the first locked position, and said second jamming pin protrudes into said second guide and prevents movement of said second carrier member out of the second locked position, when said wedge carrier is in the third locked position.

12. The twin locking socket according to claim 11, further including:

a second guide pin passing through a slot provided in said first guide and engaging a second cam track provided in said first carrier member; and a third guide pin passing through a slot provided in said second guide and engaging a third cam track provided in said second carrier member.

13. The twin locking socket according to claim 11, further comprising:

a first lateral cavity provided adjacent said first passage and in open communication therewith, said first lateral cavity housing a first conductive contact biased to protrude into said first passage;

a second lateral cavity provided adjacent said second passage and in open communication therewith, said third lateral activity housing a third conductive contact biased to protrude into said second passage;

a third lateral cavity provided adjacent said third passage and in open communication therewith, said third lateral cavity housing a third conductive contact biased to protrude into said third passage; and a fourth lateral cavity provided adjacent said fourth passage and in open communication therewith, said fourth lateral cavity housing a fourth conductive contact biased to protrude into said fourth passage, whereby said first, second, third, and fourth pair of gasping jaws are in contact with a respective one of said first, second, third, and fourth conductive contacts when said first and second carrier members are in the first and second locked positions respectively.

14. The twin locking socket according to claim 11, further comprising:

a first cap slidably mounted on said first housing and concealing said first front face, said first cap having at least two openings, said at least two openings registering with said first front opening and said second front opening respectively, said first cap being biased to contact a first plug, having at least two prongs, inserted into said first locking socket, whereby the at least two prongs of the first plug are concealed; and a second cap slidably mounted on said second housing and concealing said second front face, said second cap having at least two openings, said at least two opening and said second cap registering with said third front opening and said fourth front opening respectively, said second cap being biased to contact a second plug, having at least two prongs, inserted into said second locking socket, whereby the at least two prongs of the second plug are concealed.

15. The twin locking socket according to claim 11, further including first and second safety plugs each having at least two prongs, said first and second safty plugs being inserted in said first and second locking sockets to render said first and second locking sockets child proof.

16. The twin locking socket according to claim 11, further including a first guide pin passing through a slot provided in said key lock guide and engaging a first cam track provided in said wedge carrier.

17. The twin locking socket according to claim 16, wherein said first cam track is formed by a first groove having first and second V-shaped portions connected by first and second parallel lateral grooves, said first groove varying in depth, whereby said first guide pin can selectively be moved into sequence with said first V-shaped portion and said second V-shaped portion to thereby maintain said wedge carrier in the third locked and the third unlocked positions respectively.

18. The twin locking socket according to claim 16, wherein said second cam track is formed by a second groove having third and fourth V-shaped portions connected by third and fourth parallel lateral grooves, said second groove varying in depth, whereby said second guide pin can selectively be moved into engagement with said third V-shaped portion and said fourth V-shaped portion to thereby maintain said first carrier member in the first locked and the first unlocked positions respectively, and said third cam track is formed by a third groove having fifth and sixth V-shaped portions connected by fifth and sixth parallel lateral grooves, said third groove varying in depth, whereby said third guide pin can selectively be moved into engagement with said fifth V-shaped portion and said sixth V-shaped portion to thereby maintain said second carrier member in the second locked and the second unlocked positions respectively.

19. The twin locking socket according to claim 11, further including:

means for retaining said first and second pairs of grasping jaws in the open configuration when said first carrier member is in the first unlocked position; and means for retaining said third and fourth pairs of grasping jaws in the open configuration when said second carrier member is in the second unlocked position.

20. The twin locking socket according to claim 19, wherein said means for retaining said first and second pairs of grasping jaws in the open configuration include, a first overhang provided on said first front face of said first housing, said first overhang having first and second pairs of guide grooves therein, each of said first and second pairs of guide grooves being positioned generally above a respective pair of said first and second pairs of grasping jaws, each one of said first pair of guide grooves and each one of said second pair of guide grooves having an end proximate said first front face and an end distal from said first front face, a distance between said first pair of guide grooves and a distance between said second pair of guide grooves varying from a minimum distance, proximate said first front face, to a maximum distance, distal from said first front face, a first pair of guide extensions, each one of said first pair of guide extensions being provided on a respective one of said first pair of grasping jaws at an end thereof distal from said first support end, said first pair of guide extensions engaging respective ones of said first pair of guide grooves, and a second pair of guide extensions, each one of said second pair of guide extensions being provided on a respective one of said second pair of grasping jaws at an end thereof distal from said second support end, said second pair of guide extensions engaging respective ones of said second pair of guide grooves, whereby the ends of said first pair of grasping jaws distal from said first support end, and the ends of said second pair of grasping jaws distal from said second support end, are maintained apart at said maximum distance when said first and second pairs of grasping jaws protrude from said first front face for said first distance; and said means for retaining said third and fourth pairs of grasping jaws in the open configuration include, a second overhang provided on said second front face of said second housing, said second overhang having third and fourth pairs of guide grooves therein, each of said third and fourth pairs of guide grooves being positioned generally above a respective pair of said third and fourth pairs of grasping jaws, each one of said third pair of guide grooves and each one of said fourth pair of guide grooves having an end proximate said second front face and an end distal from said second front face, a distance between said third pair of guide grooves and a distance between said fourth pair of guide grooves varying from said minimum distance, proximate said second front face, to said maximum distance, distal from said second front face, a third pair of guide extensions, each one of said third pair of guide extensions being provided on a respective one of said third pair of grasping jaws at an end thereof distal from said third support end, said third pair of guide extensions engaging respective ones of said third pair of guide grooves, and a fourth pair of guide extensions, each one of said fourth pair of guide extensions being provided on a respective one of said fourth pair of grasping jaws at an end thereof distal from said fourth support end, said fourth pair of guide extensions engaging respective ones of said fourth pair of guide grooves, whereby the ends of said third pair of grasping jaws distal from said third support end, and the ends of said fourth pair of grasping jaws distal from said fourth support end, are maintained apart at said maximum distance when said third and fourth pairs of grasping jaws protrude from said second front face for said first distance.

* * * * *